US010030866B2

(12) United States Patent
Hyodo

(10) Patent No.: US 10,030,866 B2
(45) Date of Patent: Jul. 24, 2018

(54) BOILER SYSTEM

(71) Applicant: MIURA CO., LTD., Ehime (JP)

(72) Inventor: Yasuhiro Hyodo, Ehime (JP)

(73) Assignee: MIURA CO., LTD., Ehime (JP)

( * ) Notice: Subject to any disclaimer, the term of this patent is extended or adjusted under 35 U.S.C. 154(b) by 116 days.

(21) Appl. No.: 14/912,524

(22) PCT Filed: Aug. 7, 2014

(86) PCT No.: PCT/JP2014/070902
§ 371 (c)(1),
(2) Date: Feb. 17, 2016

(87) PCT Pub. No.: WO2015/025729
PCT Pub. Date: Feb. 26, 2015

(65) Prior Publication Data

US 2016/0201895 A1 Jul. 14, 2016

(30) Foreign Application Priority Data

Aug. 19, 2013 (JP) ..... 2013-169440

(51) Int. Cl.
*F22B 35/00* (2006.01)

(52) U.S. Cl.
CPC ..... *F22B 35/008* (2013.01)

(58) Field of Classification Search
CPC ... F22B 33/00; F22B 35/008; F24D 2200/043
USPC ..... 122/448.3
See application file for complete search history.

(56) References Cited

U.S. PATENT DOCUMENTS 4,716,858 A * 1/1988 Bartels ..... F22B 35/00 122/448.1
8,868,251 B2 * 10/2014 Hatada ..... F24H 1/10 219/200
9,518,762 B2 * 12/2016 Hatada ..... F24H 1/10
9,562,697 B2 * 2/2017 Ng ..... F24H 1/107
2010/0316963 A1 * 12/2010 Kim ..... F23N 1/002 431/12

(Continued)

FOREIGN PATENT DOCUMENTS

JP 09-287704 11/1997
JP 2009-229030 10/2009

(Continued)

*Primary Examiner* — Gregory A Wilson
(74) *Attorney, Agent, or Firm* — Muncy, Geissler, Olds & Lowe, P.C.

(57) ABSTRACT

A boiler system equipped with a boiler group mixedly provided with a step value control boiler and a proportional control boiler. A boiler number control device is configured to control the number of boilers in the boiler group, and includes an output controller configured to control a combustion state of the boiler group so as to cause the proportional control boiler to output steam equivalent to a required steam flow according to a required load, and an output switcher configured to switch, under a condition that a steam flow outputted from the proportional control boiler reaches a predetermined steam flow exceeding a steam flow at a possible combustion point of the step value control boiler, output of the steam flow at the combustion point from the proportional control boiler to the step value control boiler.

4 Claims, 9 Drawing Sheets

(56) References Cited

U.S. PATENT DOCUMENTS

2017/0130971 A1* 5/2017 Wilson ..... F22B 35/008

FOREIGN PATENT DOCUMENTS

| | | |
|---|---|---|
| JP | 2010-043768 | 2/2010 |
| JP | 2010-048462 | 3/2010 |
| JP | 2012-013276 | 1/2012 |
| JP | 2013-002784 | 1/2013 |
| JP | 2013-072609 | 4/2013 |
| JP | 2015-140976 | 8/2015 |

* cited by examiner

PRIORITY RANKING WITHIN GROUP

BOILER GROUP 2A

| RANKING WITHIN GROUP | BOILER |
|---|---|
| 1st | LOW COMBUSTION POINT OF FIRST BOILER |
| 2nd | MEDIUM COMBUSTION POINT OF FIRST BOILER |
| 3rd | LOW COMBUSTION POINT OF SECOND BOILER |
| 4th | MEDIUM COMBUSTION POINT OF SECOND BOILER |
| 5th | LOW COMBUSTION POINT OF THIRD BOILER |
| 6th | MEDIUM COMBUSTION POINT OF THIRD BOILER |
| 7th | HIGH COMBUSTION POINT OF FIRST BOILER |
| 8th | HIGH COMBUSTION POINT OF SECOND BOILER |
| 9th | HIGH COMBUSTION POINT OF THIRD BOILER |

BOILER GROUP 2B

| RANKING WITHIN GROUP | BOILER |
|---|---|
| 1st | FOURTH BOILER |
| 2nd | FIFTH BOILER |

FIG. 2B

BOILER SYSTEM

TECHNICAL FIELD

The present invention relates to a boiler system having a boiler group mixedly provided with a step value control boiler and a proportional control boiler. This application claims a priority right on the basis of JP 2013-169440 filed on Aug. 19, 2013 in Japan and its contents are incorporated herein by reference.

BACKGROUND ART

There has been proposed a boiler system including a boiler group provided with a plurality of boilers configured to combust at a changed combustion rate, and a boiler number control device configured to control a combustion state of the boiler group in accordance with a required load. Such a boiler system includes a steam header configured to store steam generated by the plurality of boilers, and the steam header supplies a loading machine with the steam.

Widely used to date as such a boiler system is a step value control boiler configured to combust at a stepwisely changed combustion rate. Also starting to spread in recent years is a boiler system including a proportional control boiler configured to combust at a continuously changed combustion rate.

A step value control boiler indicates an N-point boiler configured to combust at a plurality of stepped combustion points (e.g. a three-point boiler having a combustion stopped point, a low combustion point, and a high combustion point). Such a step value control boiler has a combustion rate changed stepwisely (e.g. every 50%). In contrast, a proportional control boiler has a combustion rate changeable by every percent or the like. The proportional control boiler can be regulated more delicately than the step value control boiler and thus has improved pressure stability.

In a boiler system including step value control boilers, a boiler number control device preliminarily sets combustion patterns of the respective boilers and causes each of the boilers to combust in a combustion pattern corresponding to steam pressure of a steam header to control a combustion state of the boiler group (see Patent Literature 1).

In a boiler system including proportional control boilers, a boiler number control device preliminarily sets target pressure and calculates a control amount according to a deviation between steam pressure of a steam header and the target pressure to control a combustion state of a boiler group (see Patent Literature 2).

CITATION LIST

Patent Literatures

Patent Literature 1: JP 2013-072609 A
Patent Literature 2: JP 2010-048462 A

SUMMARY OF INVENTION

Technical Problem

The combustion control methods disclosed in Patent Literatures 1 and 2 assume a state where the boiler group includes only step value control boilers or only proportional control boilers, failing to assume applying to a boiler group mixedly provided with a step value control boiler and a proportional control boiler.

In view of the above, an object of the present invention is to provide a boiler system mixedly provided with a step value control boiler and a proportional control boiler and configured to control the number of boilers in accordance with superiority of both of the boilers.

Solutions to Problem

The present invention relates to a boiler system including a boiler group provided with a step value control boiler configured to combust at a plurality of stepwise combustion points, and a proportional control boiler configured to combust at a continuously changed combustion rate, and a controller configured to control a combustion state of the boiler group in accordance with a required load, wherein the controller includes an output controller configured to control the combustion state of the boiler group to cause the proportional control boiler to output steam equivalent to a required steam flow according to the required load, and an output switcher configured to switch, under a condition that a steam flow outputted from the proportional control boiler reaches a predetermined steam flow exceeding a steam flow at a possible combustion point of the step value control boiler, output of the steam flow at the combustion point from the proportional control boiler to the step value control boiler.

Alternatively, the predetermined steam flow can be more than the steam flow at the combustion point by a minimum steam flow outputtable from the proportional control boiler.

Alternatively, the predetermined steam flow can be more than the steam flow at the combustion point by a steam flow corresponding to a lower limit value within an ecological operation zone in which boiler efficiency of the proportional control boiler is higher than a predetermined threshold.

Alternatively, even when the step value control boiler combusts at a combustion point with maximum efficiency and a steam flow outputted from the proportional control boiler reaches the predetermined steam flow, the output switcher can keep output from the proportional control boiler.

Advantageous Effect of Invention

According to the present invention, the proportional control boiler is used for following a load whereas the step value control boiler is used for basic combustion, enabling control of the number of boilers in accordance with superiority of both of the boilers.

BRIEF DESCRIPTION OF DRAWINGS

FIGS. 2(A) and 2(B) include a diagram and charts schematically depicting a boiler group according to this embodiment.

DESCRIPTION OF EMBODIMENTS

Figure 1:
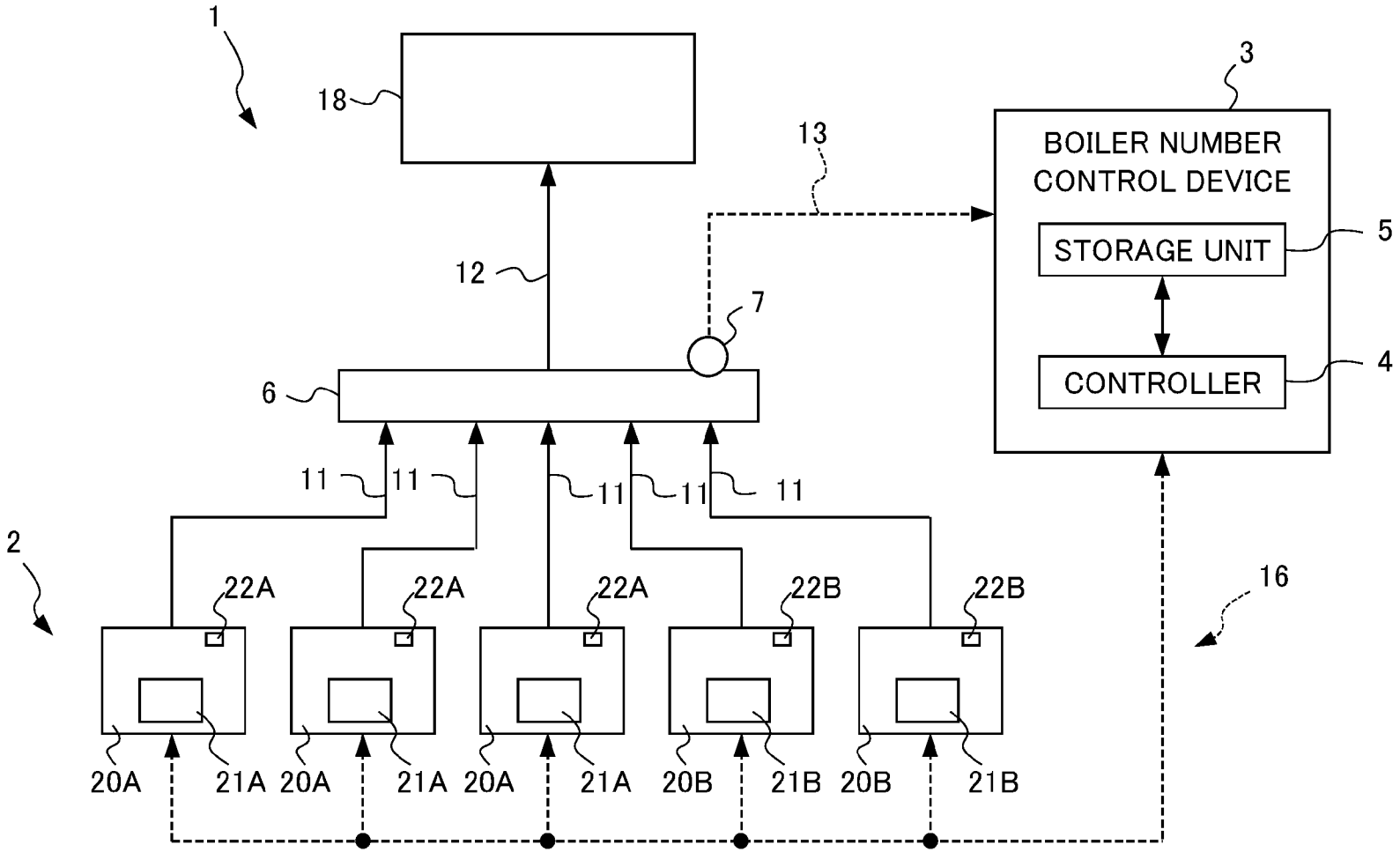
FIG. 1 is a schematic diagram of a boiler system according to the present embodiment of the present invention.

A boiler system according to each preferred embodiment of the present invention will be described below with reference to the drawings.

An entire configuration of a boiler system 1 according to the present embodiment will be described initially with reference to FIG. 1. The boiler system 1 includes a boiler group 2 mixedly provided with step value control boilers 20A and proportional control boilers 20B, a steam header 6 configured to collect steam generated by the plurality of boilers 20A and 20B, a steam pressure sensor 7 configured to measure internal pressure in the steam header 6, and a boiler number control device 3 having a controller 4 configured to control a combustion state of the boiler group 2.

As depicted in FIG. 1, the boilers 20A and 20B include boiler bodies 21A and 21B configured to perform combustion, and local controllers 22A and 22B configured to control combustion states of the boilers 20A and 20B, respectively.

The local controllers 22A and 22B change the combustion states of the boilers 20A and 20B in accordance with a consumed steam flow, respectively. Specifically, the local controllers 22A and 22B control the combustion states of the boilers 20A and 20B in accordance with a control signal transmitted from the boiler number control device 3 through a signal wire 16. The local controllers 22A and 22B also transmit a signal to be utilized by the boiler number control device 3, to a boiler number control unit through the signal wire 16. Examples of the signal utilized by the boiler number control device 3 include data on actual combustion states of the boilers 20A and 20B, and other data.

The boiler group 2 generates steam to be supplied to a steam utilizing apparatus 18.

The steam header 6 is connected, through a steam pipe 11, to each of the boilers 20A and 20B included in the boiler group 2. The steam header 6 has a downstream end connected to the steam utilizing apparatus 18 through a steam pipe 12.

The steam header 6 collects and stores steam generated by the boiler group 2 to regulate relative pressure differences and pressure variations of the plurality of boilers 20A and 20B and supply pressure regulated steam to the steam utilizing apparatus 18.

The steam pressure sensor 7 is electrically connected to the boiler number control device 3 through a signal wire 13. The steam pressure sensor 7 measures internal steam pressure (pressure of steam generated by the boiler group 2) of the steam header 6 and transmits a signal on the measured steam pressure (steam pressure signal) to the boiler number control device 3 through the signal wire 13.

The boiler number control device 3 is electrically connected to each of the boilers 20A and 20B through the signal wire 16. The boiler number control device 3 controls the combustion state of each of the boilers 20A and 20B in accordance with the internal steam pressure of the steam header 6 measured by the steam pressure sensor 7.

The boiler system 1 configured as described above can supply steam generated by the boiler group 2 to the steam utilizing apparatus 18 through the steam header 6.

A load required at the boiler system 1 (required load) corresponds to a consumed steam flow at the steam utilizing apparatus 18. The boiler number control device 3 calculates a variation of the internal steam pressure of the steam header 6 generated in accordance with a variation of the consumed steam flow from the internal steam pressure (physical quantity) of the steam header 6 measured by the steam pressure sensor 7 and controls a combustion state of each of the boilers 20A and 20B included in the boiler group 2.

Specifically, the consumed steam flow is increased by increase of a demand from the steam utilizing apparatus 18, and a steam pressure value of the steam header 6 is decreased by shortage of an output steam flow supplied to the steam header 6. In contrast, the consumed steam flow is decreased by decrease of the demand from the steam utilizing apparatus 18, and the steam pressure value of the steam header 6 is increased by excess of the output steam flow supplied to the steam header 6. The boiler number control device 3 monitors the variation of the consumed steam flow in accordance with a variation of the steam pressure value of the steam header 6. The boiler number control device 3 controls a combustion amount of each of the boilers 20A and 20B so as to generate steam equivalent to a target steam flow calculated from the steam pressure value of the steam header 6.

Figure 2A:
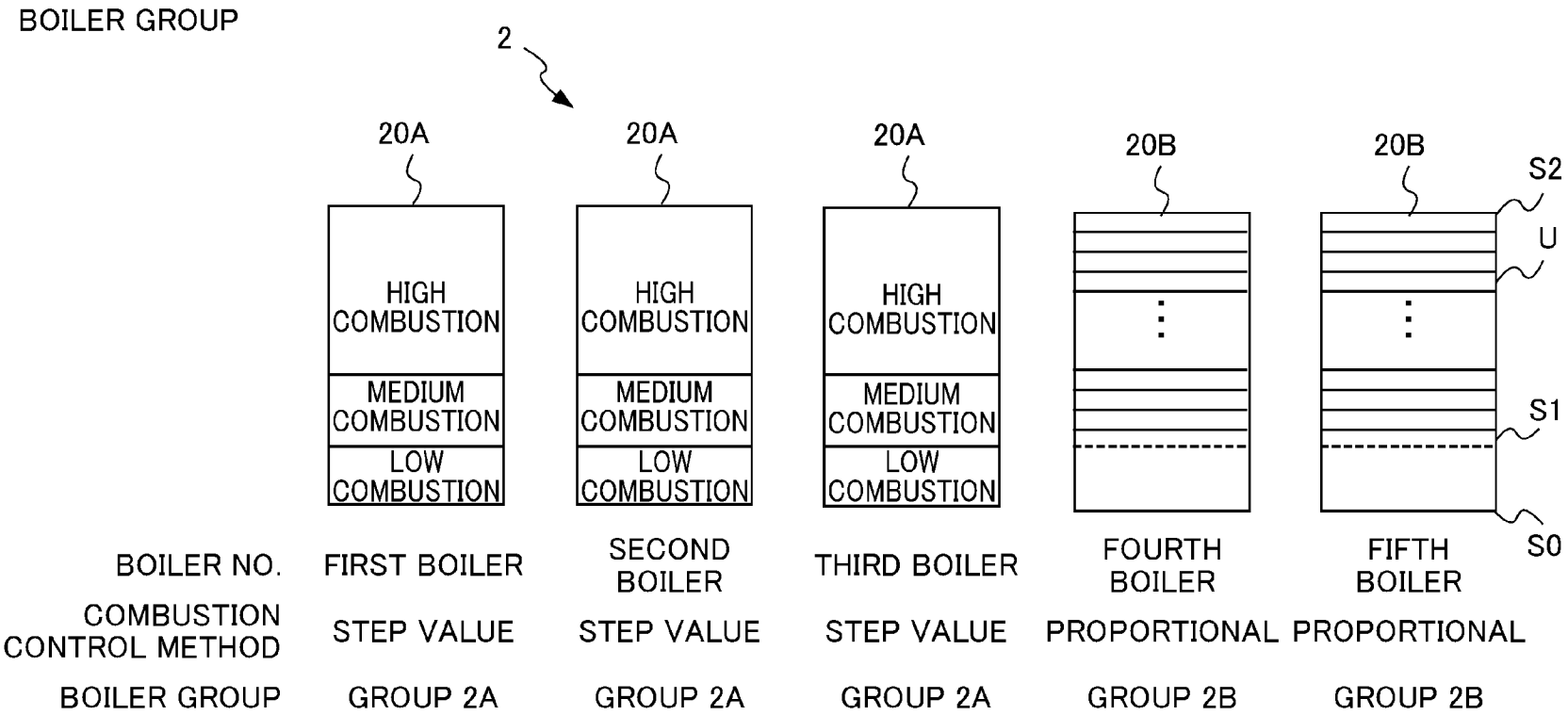

The boiler group 2 included in the boiler system 1 according to the present embodiment will now be described with reference to FIGS. 2(A) and 2(B). FIGS. 2(A) and 2(B) include a diagram and charts schematically depicting the boiler group 2 according to the present embodiment.

The boiler group 2 according to the present embodiment includes three step value control boilers 20A and two proportional control boilers 20B. The three step value control boilers 20A configure a step value control boiler group 2A whereas the two proportional control boilers configure a proportional control boiler group 2B.

(Description of Step Value Control Boiler 20A)

The step value control boilers 20A is configured to control the combustion amount by selectively starting/stopping combustion, regulating size of flame, or the like so as to stepwisely increase or decrease the combustion amount in accordance with a selected combustion point.

In each of the step value control boilers 20A according to the present embodiment, the combustion amount at each combustion point and combustion power as the maximum combustion amount (a combustion amount at a high combustion point) are set equally among the step value control boilers 20A, and the combustion state (a combustion point and a combustion rate) can be controlled to each of the following four-stepped points. The step value control boilers 20A are so-called four-point controlled boilers.

1) Combustion stopped point (first combustion point: 0%)

2) Low combustion point L (second combustion point: set to 5 to 35% of maximum combustion amount, for example; 20% in the present embodiment)

3) Medium combustion point M (third combustion point: set to 40 to 70% of maximum combustion amount, for example; 45% in the present embodiment)

4) High combustion point H (fourth combustion point: 100% (maximum combustion amount))

The step value control boilers 20A in the step value control boiler group 2A can alternatively be so-called three-point controlled boilers, instead of being controlled to the four points, configured to have the combustion amount controlled to three-stepped combustion points of the combustion stopped point (first combustion point), the low combustion point L (second combustion point), and the high combustion point H (third combustion point). The step value control boilers 20A can be still alternatively controlled to five or more combustion points. The step value control boilers 20A can be different from each other in boiler capacity, the number of the stepped combustion points, and the like.

The boilers 20A in the step value control boiler group 2A have priority levels set respectively. The priority levels of the step value control boilers 20A can be set appropriately. The step value control boilers 20A have priority levels set to each of the combustion points in the present embodiment. Specifically, as depicted in FIG. 2(B), the first boiler has the first priority level set to the low combustion point L and the second priority level set to the medium combustion point M. The third priority level is set not to the high combustion point H of the first boiler but to the low combustion point L of the second boiler. FIG. 2(B) merely depicts exemplary setting of the priority levels.

The boiler number control device 3 (controller 4) causes the step value control boilers 20A of higher priority levels to sequentially combust (at the corresponding combustion points) and causes the step value control boilers 20A of lower priority levels to sequentially stop combustion (at the corresponding combustion points).

Figure 3:
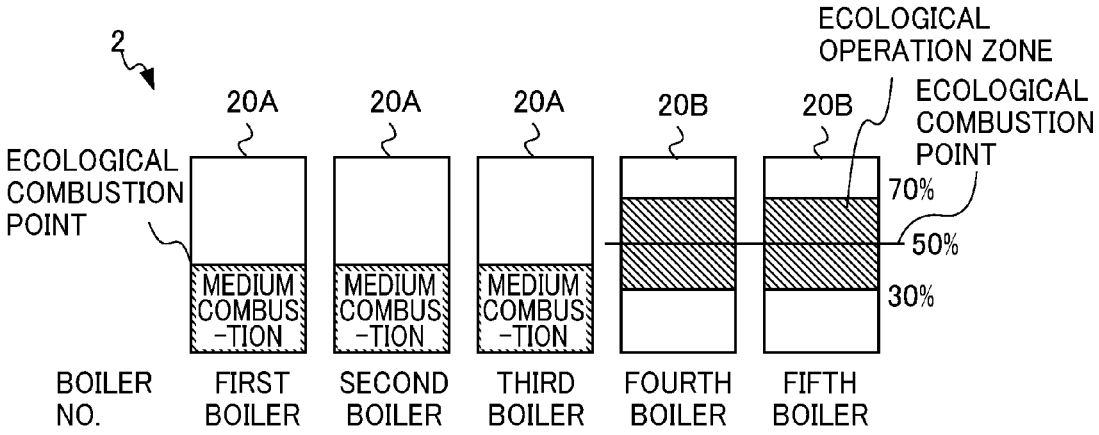
FIG. 3 is a diagram depicting boiler properties of step value control boilers and proportional control boilers included in the boiler group.

The step value control boilers 20A will subsequently be described in terms of boiler properties (efficiency properties). FIG. 3 is a diagram depicting boiler properties of the step value control boilers 20A and the proportional control boilers 20B included in the boiler group 2.

The step value control boilers 20A each combust at the plurality of stepwise combustion points, and have the boiler efficiency (thermal efficiency of the step value control boiler 20A) which differs among the combustion points. As depicted in FIG. 3, the step value control boilers 20A according to the present embodiment each have a combustion point with the maximum combustion efficiency in terms of combustion (ecological combustion point) among the plurality of combustion points, and such a combustion point is set to the medium combustion point M.

(Description of Proportional Control Boiler 20B)

The proportional control boiler 20B has a combustion amount that can be controlled continuously at least in a range from a minimum combustion state S1 (e.g., a combustion state with the combustion amount corresponding to 20% of the maximum combustion rate) to a maximum combustion state S2. The combustion amount of the proportional control boiler 20B is regulated by control of an opening degree (combustion ratio) of a valve configured to supply fuel to a burner or a valve configured to supply combustion air.

Continuous control of a combustion amount includes a case where output (combustion amount) of the proportional control boiler 20B can be controlled actually continuously even when calculation and signals are digital and processed stepwisely in the local controller 22B (e.g., when the output is controlled by every percent).

According to the present embodiment, a change of the combustion state between a combustion stopped state S0 and the minimum combustion state S1 of the proportional control boiler 20B is controlled by starting/stopping combustion of the proportional control boiler 20B (burner). The combustion amount can be controlled continuously in the range from the minimum combustion state S1 to the maximum combustion state S2.

More specifically, the plurality of proportional control boilers 20B each has a unit steam flow U, which is set as a unit of a variable steam flow. The steam flow of each of the proportional control boilers 20B can thus be changed by the unit steam flow U in the range from the minimum combustion state S1 to the maximum combustion state S2.

The unit steam flow U can be set appropriately in accordance with the steam flow in the maximum combustion state S2 (maximum steam flow) of the proportional control boiler 20B. In order for improvement in followability of an output steam flow to a necessary steam flow in the boiler system 1, the unit steam flow U is set preferably to 0.1% to 20% of the maximum steam flow of the proportional control boiler 20B and more preferably to 1% to 10% thereof.

As depicted in FIG. 2(B), the plurality of proportional control boilers 20B belonging to the proportional control boiler group 2B has priority levels set respectively. According to the present embodiment, the proportional control boilers 20B of higher priority levels are sequentially increased in combustion rate if the consumed steam flow has increased, whereas the proportional control boilers 20B of lower priority levels are sequentially decreased in combustion rate if the consumed steam flow has decreased.

The proportional control boilers 20B will subsequently be described in terms of boiler properties (efficiency properties) with reference to FIG. 3.

The proportional control boilers 20B each have a combustion rate that can be changed continuously in the range from the minimum combustion state S1 to the maximum combustion state S2, and the boiler efficiency (thermal efficiency of the proportional control boiler 20B) which differs depending on the combustion rate. An ecological operation point is set to the combustion rate with the highest boiler efficiency (e.g., 98%), and an ecological operation zone is set to the range of the combustion rate in which the boiler efficiency is higher than a predetermined value (e.g., 97%). With reference to FIG. 3, the proportional control boilers 20B have an ecological operation point at the combustion rate of 50%, and an ecological zone with a combustion rate in the range from 30% to 70%.

The boiler number control device 3 will be described next in terms of its configuration. As depicted in FIG. 1, the boiler number control device 3 includes the controller 4 and a storage unit 5.

The controller 4 transmits various commands to the step value control boilers 20A and the proportional control boilers 20B and receives various data from each of the boilers 20A and 20B through the signal wire 16, to control the combustion states of the step value control boilers 20A and the proportional control boilers 20B and the number of operating boilers. When any one of the boilers 20A and 20B receives a command signal for a change of a combustion state from the boiler number control device 3, the corresponding boiler 20A or 20B controls its combustion amount in accordance with the command. The controller 4 is to be described later in terms of its detailed configuration.

The storage unit 5 stores information on the commands transmitted to the respective boilers 20A and 20B, information on the combustion states received from the respective boilers 20A and 20B, information on the priority levels of the respective boilers 20A and 20B, and the like.

Figure 4:
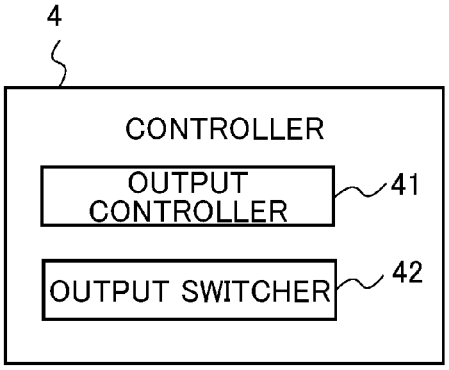
FIG. 4 is a block diagram depicting a functional configuration of a controller of a boiler number control device.

The controller 4 will be described next in more detail in terms of its configuration. In the present embodiment, the proportional control boiler 20B is made to combust initially in accordance with a request from the steam utilizing apparatus 18. When the steam flow outputted from this proportional control boiler 20B reaches the steam flow outputtable from the step value control boiler 20A, the step value control boiler 20A is made to combust so that output of the steam flow is switched from the proportional control boiler 20B to the step value control boiler 20A. As depicted in FIG. 4, the controller 4 includes an output controller 41 and an output switcher 42 in order to achieve such control.

The output controller 41 controls the combustion state of the boiler group 2 so that the proportional control boiler 20B outputs steam equivalent to a required steam flow corresponding to a required load. The output controller 41 continuously controls the combustion rate of the proportional control boiler 20B so as to cause the steam flow outputted from the boiler group 2 to follow the required steam flow.

Under the condition that, with the control by the output controller 41, the steam flow outputted from the proportional control boiler 20B reaches a predetermined steam flow exceeding the steam flow at a possible combustion point of the step value control boiler 20A, the output switcher 42 switches output of the steam flow at the combustion point from the proportional control boiler 20B to the step value control boiler 20A.

The output switcher 42 switches output of the steam flow from the proportional control boiler 20B to the step value control boiler 20A in accordance with the priority level set to the step value control boiler 20A, the detail of which will be described later. For example, in a case where all the step value control boilers 20A stops combustion, the low combustion point L of the first boiler with the first priority level has the highest priority level. Accordingly, under the condition that the steam flow outputted from the proportional control boiler 20B reaches the predetermined steam flow exceeding the steam flow at the low combustion point L of the first boiler, the output switcher 42 switches output of the steam flow from the proportional control boiler 20B to the low combustion point L of the first boiler.

The predetermined steam flow at which the output switcher 42 performs switching can be set appropriately. In this regard, the predetermined steam flow according to the present embodiment is set in view of stability of the boiler system 1 or efficient combustion of the proportional control boiler 20B.

When output of the steam flow is switched from the proportional control boiler 20B to the step value control boiler 20A, the proportional control boiler 20B outputs a less steam flow with less combustion efficiency. The predetermined steam flow is set in view of the above point assuming such decrease in combustion rate.

Described below is setting the predetermined steam flow in view of stability of the boiler system 1.

As described earlier, the proportional control boiler 20B operates rather stepwisely by starting/stopping combustion from the combustion stopped state S0 to the minimum combustion state S1. The proportional control boiler 20B stops combustion if the combustion rate decreased due to switching is less than that in the minimum combustion state S1. The proportional control boiler 20B may repeatedly start and stop combustion depending on subsequent load variations.

Accordingly set as the predetermined steam flow is the steam flow more than that at a possible combustion point of the step value control boiler 20A by the minimum steam flow outputted from the proportional control boiler 20B in the minimum combustion state S1. With the setting, even when the combustion rate of the proportional control boiler 20B decreases due to switching by the output switcher 42, the combustion rate of the proportional control boiler 20B decreases only to the combustion rate in the minimum combustion state S1 and the proportional control boiler 20B will not stop combustion.

Described below is setting the predetermined steam flow in view of efficient combustion of the proportional control boiler 20B.

As described earlier, the proportional control boiler 20B has the range of the combustion rate with high boiler efficiency (ecological operation zone). The proportional control boiler 20B can combust efficiently if the proportional control boiler 20B is made to continuously combust in this ecological operation zone.

The predetermined steam flow is thus set so that the combustion rate of the proportional control boiler 20B falls within the range of the ecological operation zone even when the combustion rate of the proportional control boiler 20B decreases due to switching by the output switcher 42. For example, set as the predetermined steam flow is the steam flow more than that at a possible combustion point of the step value control boiler 20A by the steam flow outputted at the combustion rate equal to the lower limit value within the ecological operation zone. The proportional control boiler 20B can thus be made to continuously combust in the range of the ecological operation zone.

The above switching from the proportional control boiler 20B to the step value control boiler 20A is performed in a case where the required load increases. In another case where the required load decreases, the output switcher 42 switches from the step value control boiler 20A to the proportional control boiler 20B. Specifically, the output switcher 42 switches output of the steam flow from the step value control boiler 20A to the proportional control boiler 20B under the condition that the steam flow outputted from the proportional control boiler 20B reaches a specific steam flow in a state where the step value control boiler 20A is combusting.

The output switcher 42 switches output of the steam flow from the step value control boiler 20A to the proportional control boiler 20B in accordance with the priority level set to the step value control boiler 20A, the detail of which will be described later. For example, in a case where all the step value control boilers 20A are combusting, the high combustion point H of the third boiler with the ninth priority level has the lowest priority level. Accordingly, under the condition that the steam flow outputted from the proportional control boiler 20B reaches the specific steam flow, the output switcher 42 changes the combustion point of the third boiler from the high combustion point H to the medium combustion point M, and switches output equivalent to the steam flow at the high combustion point H of the third boiler (high combustion point H-medium combustion point M) from the third boiler to the proportional control boiler 20B.

Similarly to the predetermined steam flow, the specific steam flow can be set appropriately. The present embodiment exemplifies a case where the specific steam flow is set to the minimum steam flow of the proportional control boiler 20B or the steam flow outputted from the proportional control boiler 20B at the combustion rate equal to the lower limit value within the ecological operation zone.

Figure 5:
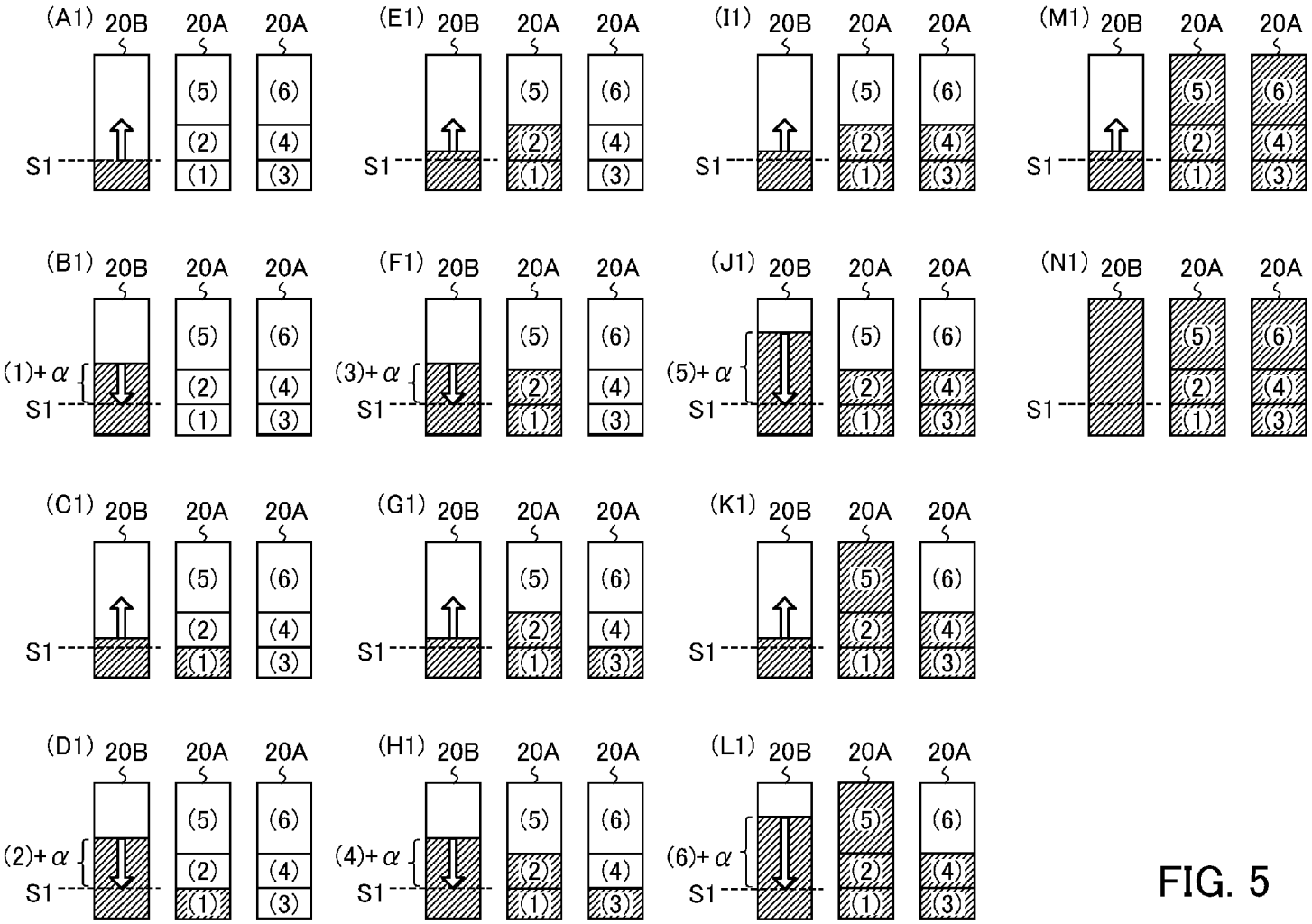
FIG. 5 shows diagrams (A1)-(N1) depicting operation examples for a case of switching output of a steam flow between the step value control boilers and the proportional control boiler.
Figure 6:
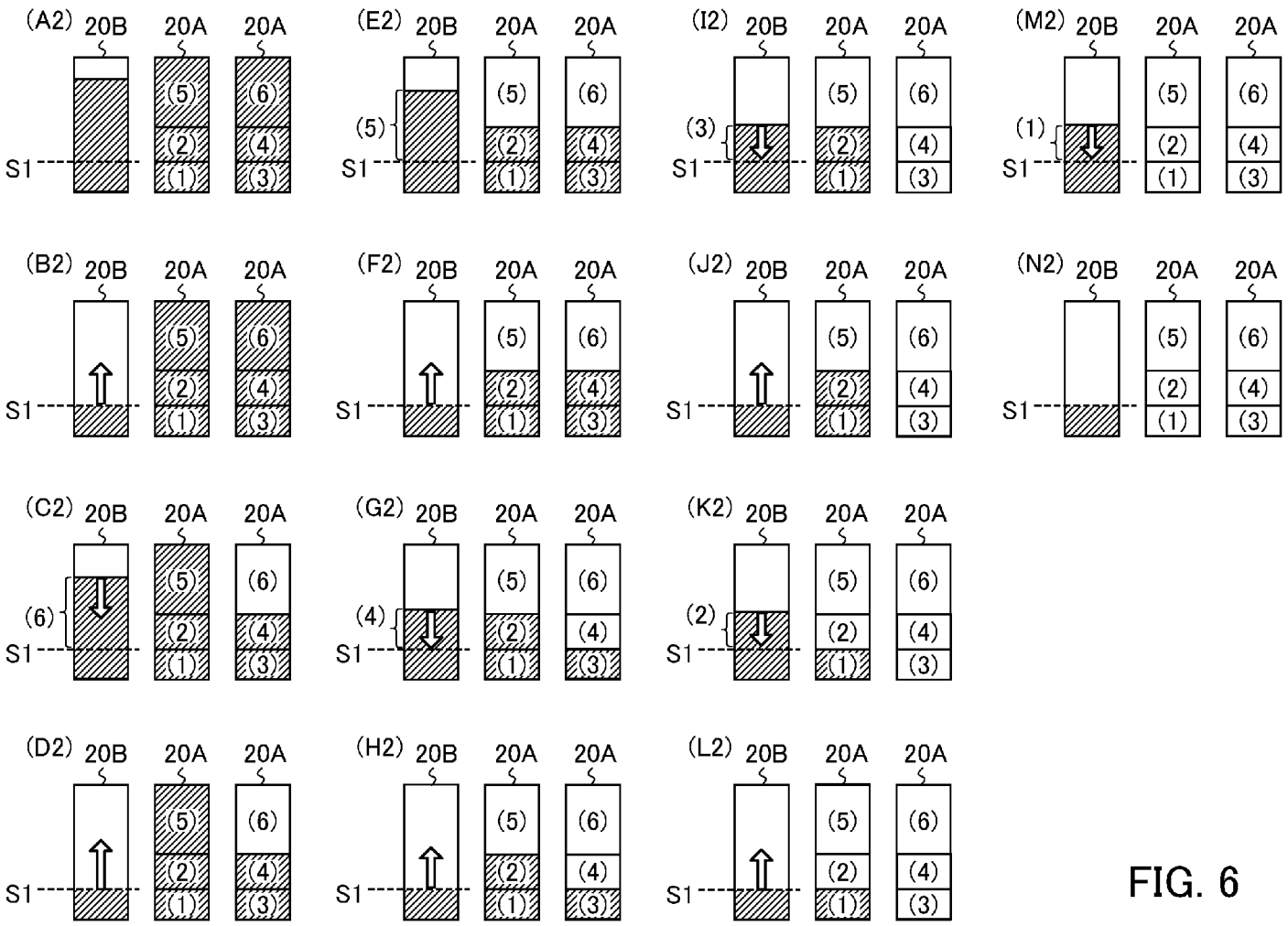
FIG. 6 shows diagrams (A2)-(N2) depicting operation examples for a case of switching output of the steam flow between the step value control boilers and the proportional control boiler.

The boiler system 1 has been described above in terms of its configuration. The boiler system 1 will subsequently be described in terms of its operation. Diagrams (A1)-(N1) of FIG. 5 depict operation upon switching of output of the steam flow from the proportional control boiler 20B to the step value control boiler 20A whereas diagrams (A2)-(N2) of FIG. 6 depict operation upon switching of output of the steam flow from the step value control boiler 20A to the proportional control boiler 20B. The operation depicted in diagrams (A1)-(N1) of FIG. 5 is of the case where the predetermined steam flow is set to the steam flow more than that at a possible combustion point of the step value control boiler 20A by the minimum steam flow of the proportional control boiler 20B. The operation depicted in diagrams (A2)-(N2) of FIG. 6 is of the case where the specific steam flow is set to the minimum steam flow of the proportional control boiler 20B.

For the purpose of simplified description, FIGS. 5 and 6 assume that the boiler group 2 includes three boilers 20A and 20B in total, specifically, two step value control boilers 20A and one proportional control boiler 20B, and the two step value control boilers 20A have the priority levels (1) to (6) set as in these figures.

With reference to FIG. 5 (diagram A1), the step value control boilers 20A stop combustion whereas the proportional control boiler 20B is combusting in the minimum combustion state S1.

If the required load increases in this state, the output controller 41 increases the combustion rate of the proportional control boiler 20B so as to cause the steam flow outputted from the boiler group 2 to follow the required load.

As depicted in FIG. 5 (diagram B1), the steam flow outputted from the proportional control boiler 20B increases to the steam flow (predetermined steam flow) more than the minimum steam flow of the proportional control boiler 20B by the steam flow (+α) outputted from the step value control boiler 20A at the combustion point with the first priority level (low combustion point L). The expression +α indicates a surplus value for securement of stability of the boiler system 1.

When the steam flow outputted from the proportional control boiler 20B reaches the predetermined steam flow, the output switcher 42 switches output of the steam flow from the proportional control boiler 20B to the step value control boiler 20A. Specifically, as depicted in FIG. 5 (diagram C1), the step value control boiler 20A, which has stopped combustion, starts combustion at the low combustion point L with the first priority level whereas the steam flow outputted from the proportional control boiler 20B is decreased by the amount equivalent to the steam flow at the low combustion point L.

Subsequently, when the output controller 41 similarly increases the steam flow outputted from the proportional control boiler 20B to the steam flow (predetermined steam flow) more than the minimum steam flow of the proportional control boiler 20B by the steam flow (+α) outputted from the step value control boiler 20A at the combustion point with the second priority level (medium combustion point M) (FIG. 5 (diagram D1)), the output switcher 42 switches output of the steam flow from the proportional control boiler 20B to the step value control boiler 20A with the second priority level (medium combustion point M) (FIG. 5 (diagram E1)).

When the output controller 41 subsequently increases the steam flow outputted from the proportional control boiler 20B to the steam flow (predetermined steam flow) more than the minimum steam flow of the proportional control boiler 20B by the steam flow (+α) outputted from the step value control boiler 20A at the combustion point with the third, fourth, fifth, or sixth priority level, the output switcher 42 similarly switches output of the steam flow from the proportional control boiler 20B to the step value control boiler 20A (diagrams (F1)-(N1) of FIG. 5).

Subsequently with reference to FIG. 6 (diagram A2), the step value control boilers 20A combust at the combustion points with all the first to sixth priority levels whereas the proportional control boiler 20B is combusting at a predetermined combustion rate. If the required load decreases in this state, the output controller 41 decreases the combustion rate of the proportional control boiler 20B so as to cause the steam flow outputted from the boiler group 2 to follow the required load.

As depicted in FIG. 6 (diagram B2), the steam flow outputted from the proportional control boiler 20B accordingly decreases to the minimum steam flow of the proportional control boiler 20B.

The output switcher 42 then switches output of the steam flow from the step value control boiler 20A to the proportional control boiler 20B. Specifically, as depicted in FIG. 6 (diagram C2), the step value control boiler 20A, which has been combusting, stops combustion at the high combustion point H with the sixth priority level whereas the steam flow outputted from the proportional control boiler 20B is increased by the amount equivalent to the steam flow at the high combustion point H.

Subsequently, when the output controller 41 similarly decreases the steam flow outputted from the proportional control boiler 20B to the minimum steam flow (FIG. 6 (diagram D2)), the output switcher 42 switches output of the steam flow from the step value control boiler 20A with the fifth priority level (high combustion point H) to the proportional control boiler 20B (FIG. 6 (diagram E2)).

When the output controller 41 subsequently decreases the steam flow outputted from the proportional control boiler 20B to the minimum steam flow, the output switcher 42 similarly switches output of the steam flow from the step value control boilers 20A with the fourth, third, second, and first priority levels to the proportional control boiler 20B (diagrams (F2)-(N2) of FIG. 6).

Figure 7:
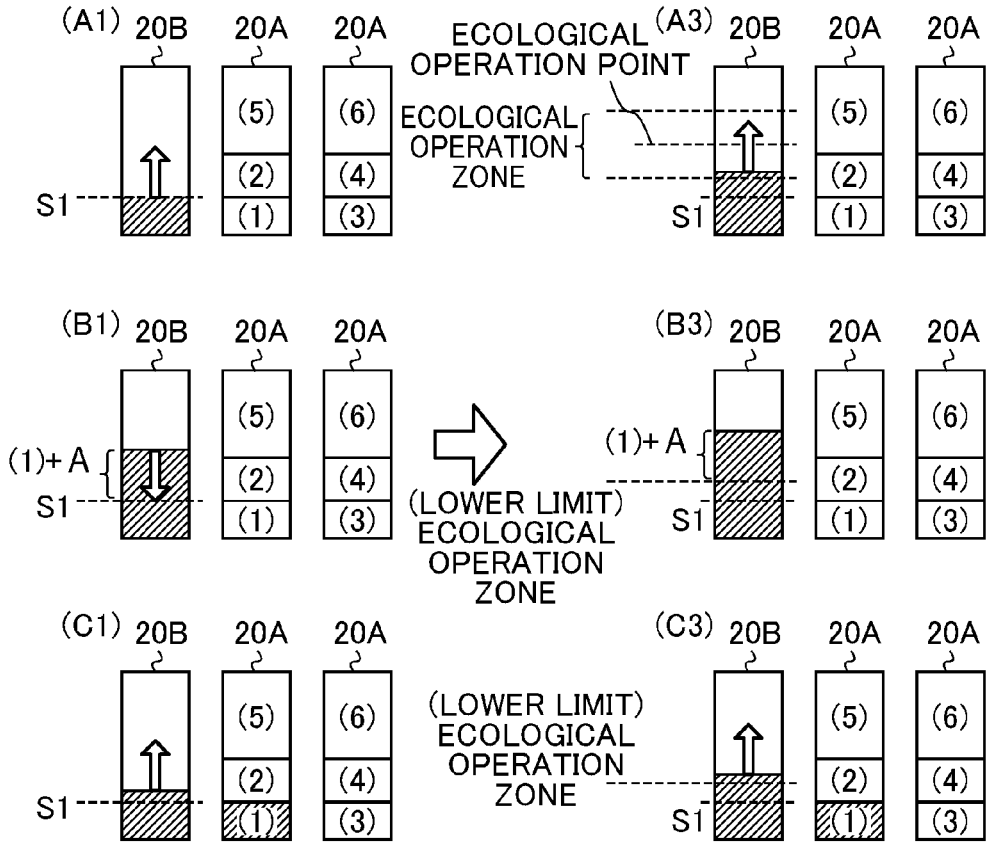
FIG. 7 shows diagrams (A1)-(C1) and (A3)-(C3) depicting operation examples for a case of switching output of the steam flow between the step value control boilers and the proportional control boiler.
Figure 8:
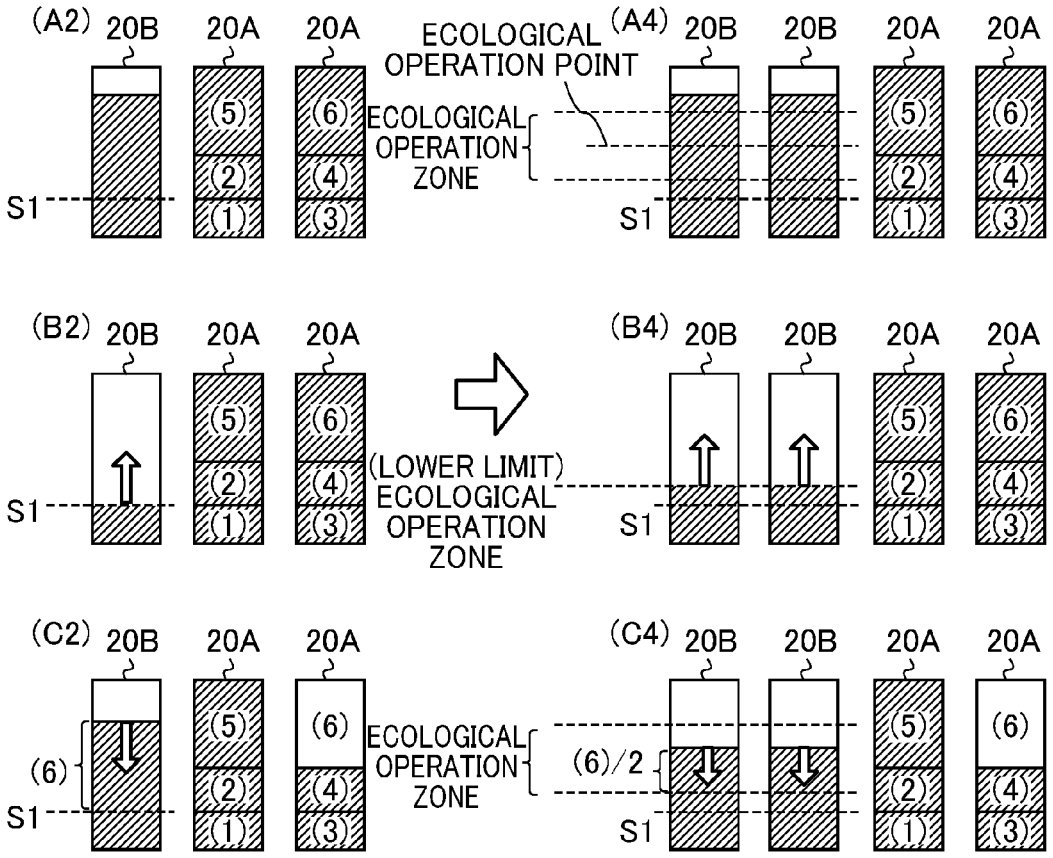
FIG. 8 shows diagrams (A2)-(C2) and (A4)-(C4) depicting operation examples for a case of switching output of the steam flow between the step value control boilers and the proportional control boilers.

Described subsequently with reference to diagrams (A1)-(C1) and (A3)-(C3) of FIG. 7, and diagrams (A2)-(C2) and (A4)-(C4) of FIG. 8 are operation of the case where the predetermined steam flow is set to the steam flow more than that at a possible combustion point of the step value control boiler 20A by the steam flow outputted at the combustion rate equal to the lower limit value within the ecological operation zone, and operation of the case where the specific steam flow is set to the steam flow outputted at the combustion rate equal to the lower limit value within the ecological operation zone.

Diagrams (A1)-(C1) of FIG. 7 correspond to diagrams (A1)-(C1) of FIG. 5, respectively, and depict operation of the case where the predetermined steam flow is set to the steam flow more than that at a possible combustion point of the step value control boiler 20A by the minimum steam flow of the proportional control boiler 20B. In contrast, diagrams (A3)-(C3) of FIG. 7 depict operation of the case where the predetermined steam flow is set to the steam flow more than that at a possible combustion point of the step value control boiler 20A by the steam flow outputted at the combustion rate equal to the lower limit value within the ecological operation zone.

Diagrams (A1)-(C1) of FIG. 7 are different from diagrams (A3)-(C3) of FIG. 7, respectively, in timing of switching output of the steam flow from the proportional control boiler 20B to the step value control boiler 20A. Specifically, in diagrams (A1)-(C1) of FIG. 7, when the steam flow outputted from the proportional control boiler 20B increases to be more than the steam flow at a possible combustion point of the step value control boiler 20A by the minimum steam flow (+α), output of the steam flow is switched to the step value control boiler 20A. In contrast, in diagrams (A3)-(C3) of FIG. 7, when the steam flow outputted from the proportional control boiler 20B increases to be more than the steam flow at a possible combustion point of the step value control boiler 20A by the steam flow (+α) outputted at the combustion rate equal to the lower limit value within the ecological operation zone, output of the steam flow is switched to the step value control boiler 20A.

It is preferred to switch output of the steam flow as depicted in FIG. 7, diagrams (A3)-(C3), because the proportional control boiler 20B can be made to combust in the range of the ecological operation zone even after the switching.

Diagrams (A2)-(C2) of FIG. 8 correspond to diagrams (A2)-(C2) of FIG. 6, respectively, and depict operation of the case where the specific steam flow is set to the minimum steam flow of the proportional control boiler 20B. In contrast, diagrams (A4)-(C4) of FIG. 8 depict operation of the case where the specific steam flow is set to the steam flow outputted at the combustion rate equal to the lower limit value within the ecological operation zone.

FIG. 8, diagrams (A4)-(C4), assume that the boiler group 2 includes four boilers 20A and 20B in total, specifically, two step value control boilers 20A and two proportional control boilers 20B.

Diagrams (A2)-(C2) of FIG. 8 are different from diagrams (A4)-(C4) of FIG. 8, respectively, in timing of switching output of the steam flow from the step value control boiler 20A to the proportional control boiler 20B. Specifically, in FIG. 8, diagrams (A2)-(C2), when the steam flow outputted from the proportional control boiler 20B decreases to the minimum steam flow, output of the steam flow is switched from the step value control boiler 20A to the proportional control boiler 20B. In contrast, in FIG. 8, diagrams (A4)-(C4), when the steam flow outputted from the proportional control boiler 20B decreases to the steam flow outputted at the combustion rate equal to the lower limit value within the ecological operation zone, output of the steam flow is switched from the step value control boiler 20A to the proportional control boiler 20B.

It is preferred to switch output of the steam flow as depicted in FIG. 8, diagrams (A4)-(C4), because the proportional control boiler 20B can be made to combust in the range of the ecological operation zone for a long period of time.

There is provided one proportional control boiler 20B in FIG. 8, diagrams (A2)-(C2), whereas there are provided two proportional control boilers 20B in FIG. 8, diagrams (A4)-(C4).

In this regard, with the single proportional control boiler 20B, when output of the steam flow is switched from the step value control boiler 20A to the proportional control boiler 20B, the switched steam flow is allocated only to the proportional control boiler 20B. With reference to FIG. 8, diagrams (B2) and (C2), the output switcher 42 switches the steam flow equivalent to that at the high combustion point H of the step value control boiler 20A with the sixth priority level to the single proportional control boiler 20B. In other words, the steam flow outputted from the proportional control boiler 20B increases by the amount equivalent to the steam flow at the high combustion point H with the sixth priority level.

In contrast, with the two (plurality of) proportional control boilers 20B, when output of the steam flow is switched from the step value control boiler 20A to the proportional control boilers 20B, the switched steam flow is allocated to the two (plurality of) proportional control boilers 20B. With reference to FIG. 8, diagrams (B4) and (C4), the output switcher 42 switches the steam flow equivalent to that at the high combustion point H of the step value control boiler 20A with the sixth priority level to the two proportional control boilers 20B. In other words, the steam flow outputted from each of the two proportional control boilers 20B increases by a half of the steam flow at the high combustion point H with the sixth priority level.

Exemplary operation of the boiler system 1 has been described above. As described earlier, the step value control boilers 20A each have a combustion point with the maximum combustion efficiency in terms of combustion (ecological combustion point) among the plurality of combustion points. In this regard, no consideration is made to the boiler efficiency of the step value control boilers 20A in FIGS. 5-8. Output of the steam flow can alternatively be switched in consideration of the efficiency of the step value control boilers 20A.

Figure 9:
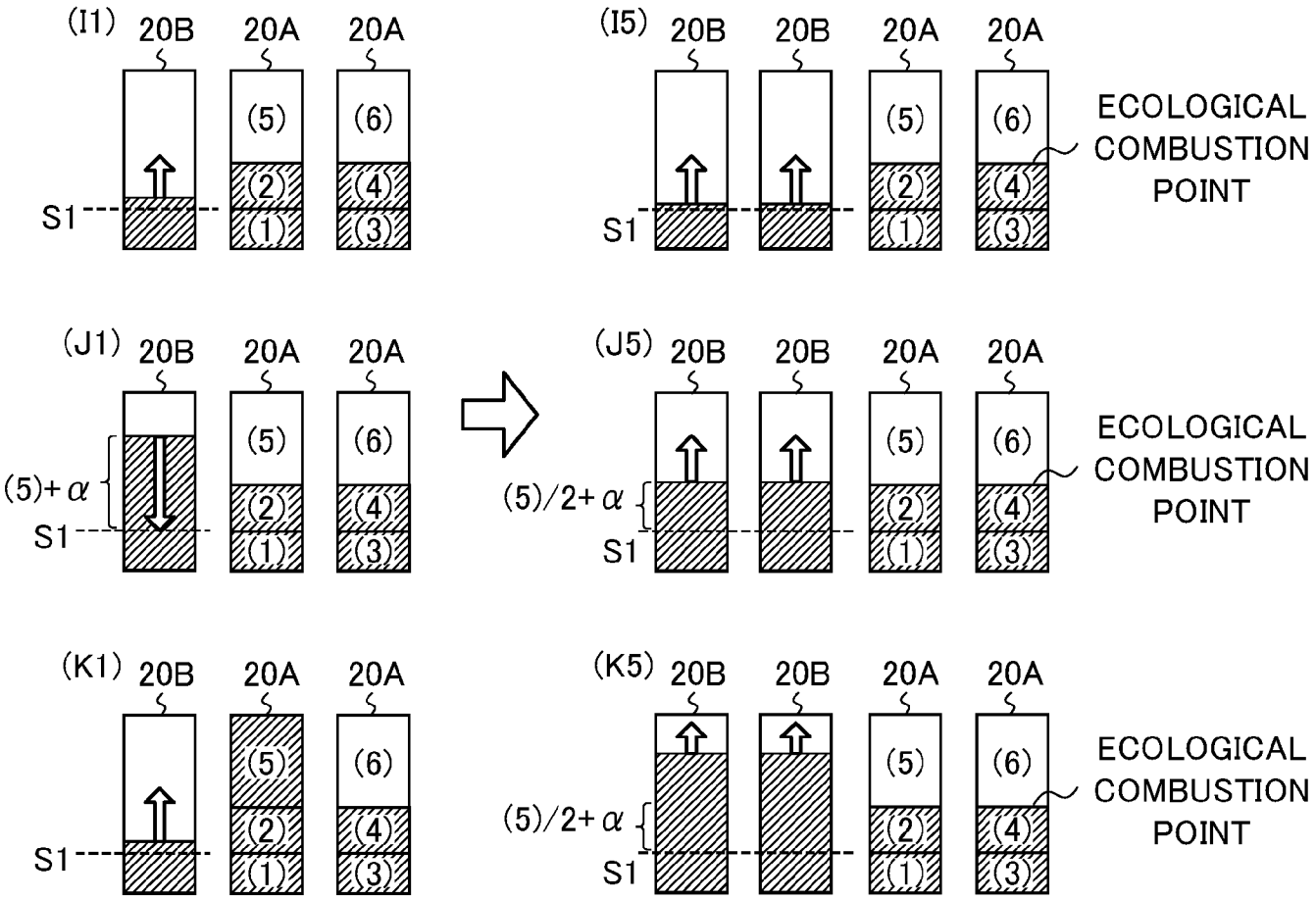
FIG. 9 shows diagrams (I1)-(K1) and (I5)-(K5) depicting operation examples for a case of switching output of the steam flow between the step value control boilers and the proportional control boilers.

FIG. 9 shows diagrams (I1)-(K1) and (I5)-(K5) depicting operation of the boiler system 1 in consideration of the boiler efficiency of the step value control boilers 20A. Diagrams (I1)-(K1) of FIG. 9 correspond to diagrams (I1)-(K1) of FIG. 5, respectively. Diagrams (I5)-(K5) of FIG. 9 depict operation examples of the case where there are two proportional control boilers 20B. As described above, in the case where there are two (plurality of) proportional control boilers 20B, the steam flow switched by the output switcher 42 has a value obtained by dividing by the number of the proportional control boilers 20B.

With reference to diagram (I1) of FIG. 9, when output of the steam flow is switched from the proportional control boiler 20B to the step value control boilers 20A, the step value control boilers 20A combust at the medium combustion point M with the fourth priority level. The medium combustion point M of the step value control boilers 20A is assumed as the ecological combustion point.

In no consideration of the boiler efficiency of the step value control boilers 20A, when the steam flow outputted from the proportional control boiler 20B subsequently increases to reach the predetermined steam flow (FIG. 9 (diagram J1)), the output switcher 42 switches output of the steam flow from the proportional control boiler 20B to the step value control boiler 20A. As depicted in FIG. 9 (diagram K1), the step value control boiler 20A is thus made to combust at the high combustion point H displaced from the ecological combustion point.

Operation in consideration of the boiler efficiency of the step value control boilers 20A will now be described with reference to diagrams (I5)-(K5) of FIG. 9. In FIG. 9 (diagram I5), the step value control boilers 20A are combusting at the ecological combustion point (medium combustion point M).

As depicted in FIG. 9 (diagram J5), when the required load subsequently increases, the steam flow outputted from the proportional control boilers 20B increases to the predetermined steam flow. There are two proportional control boilers 20B in FIG. 9 (diagram J5). The steam flow outputted from the two proportional control boilers 20B increases to the predetermined steam flow at the timing when the steam flow outputted from each of the proportional control boilers 20B increases to be more than the minimum steam flow by a half of the steam flow at the high combustion point H with the fifth priority level.

In no consideration of the boiler efficiency of the step value control boilers 20A, the output switcher 42 switches output of the steam flow from the proportional control boilers 20B to the step value control boilers 20A if the steam flow outputted from the proportional control boilers 20B increases to the predetermined steam flow. In consideration of the boiler efficiency of the step value control boilers 20A, the output switcher 42 does not switch output of the steam flow from the proportional control boilers 20B to the step value control boilers 20A even when the steam flow outputted from the proportional control boilers 20B increases to the predetermined steam flow. As depicted in FIG. 9 (diagram K5), the steam flow outputted from the proportional control boilers 20B accordingly increases beyond the predetermined steam flow.

The step value control boilers 20A can thus be made to combust efficiently. If, for example, the combustion rate of each of the proportional control boilers 20B increases to the maximum combustion rate in this case, the output switcher 42 switches output of the steam flow from the proportional control boilers 20B to the step value control boilers 20A.

The boiler system 1 according to the present embodiment described above exerts the following effects.

(1) When the required load increases in the boiler system 1 according to the present embodiment, the output controller 41 increases the steam flow outputted from the proportional control boiler 20B so as to cause the outputted steam flow to follow the required load. When the steam flow outputted from the proportional control boiler 20B reaches the predetermined steam flow exceeding the steam flow of the step value control boiler 20A at the combustion point with the highest priority level, the output switcher 42 switches output equivalent to the steam flow at the combustion point from the proportional control boiler 20B to the step value control boiler 20A.

Using the proportional control boiler 20B that can continuously change the combustion rate for regulation of a difference from the required load, when the difference increases to be equivalent to the steam flow at the combustion point of the step value control boiler 20A, the steam flow corresponding to the difference is allocated to the step value control boiler 20A assuming that this difference is generated constantly. Accordingly, the proportional control boiler 20B can be used to follow the required load whereas the step value control boiler 20A can be used for basic combustion for generation of the constantly required steam flow. The number of boilers can thus be controlled in accordance with superiority of each of the boilers.

(2) The predetermined steam flow is set to the steam flow more than the steam flow at a combustion point of the step value control boiler 20A by the minimum steam flow outputtable from the proportional control boiler 20B, so that the proportional control boiler 20B can be made to continuously combust even when output of the steam flow is switched from the proportional control boiler 20B to the step value control boiler 20A. In other words, output of the steam flow can be switched with no starting or stopping of the proportional control boiler 20B, so that the boiler system 1 can operate stably.

(3) The predetermined steam flow is set to the steam flow more than the that at a possible combustion point of the step value control boiler 20A by the minimum steam flow of the proportional control boiler 20B, so that the proportional control boiler 20B can be made to combust in the range of the ecological operation zone even when output of the steam flow is switched from the proportional control boiler 20B to the step value control boiler 20A. The proportional control boiler 20B can be made to combust efficiently, so that the boiler system 1 can operate efficiently.

(4) With the step value control boiler 20A being combusting at the ecological combustion point, the output switcher 42 will not perform switching even when the steam flow outputted from the proportional control boiler reaches the predetermined steam flow. The step value control boiler 20A for basic combustion can be made to continuously combust efficiently, so that the boiler system 1 can operate efficiently.

The boiler system 1 according to the preferred embodiment of the present invention is described above. The present invention is not limited to this embodiment but can be modified where appropriate.

For example, the present invention is applied to the boiler system equipped with the boiler group 2 including the five boilers 20A and 20B in the present embodiment. The present invention is, however, not limited this case. The present invention is applicable if the boiler group 2 is mixedly provided with at least one step value control boiler 20A and at least one proportional control boiler 20B.

In the above embodiment, the predetermined steam flow and the specific steam flow are set in accordance with the lower limit value within the ecological operation zone of the proportional control boiler 20B. In this regard, the predetermined steam flow and the specific steam flow are set in accordance with the lower limit value within the ecological operation zone in order to cause the proportional control boiler 20B to combust in the range of the ecological operation zone before and after switching. Such setting can be made not in accordance with the lower limit value but in accordance with any appropriate value within the range of the ecological operation zone.

The present invention can be embodied in other various modes without departing from the spirit or the leading features thereof. The embodiment or the example described above are thus merely exemplary on any points and should not be interpreted limitedly. The scope of the present invention is to be recited in the claims and is never restricted by the description. Any modification and alteration within the equivalent range of the claims are made within the scope of the present invention.

REFERENCE SIGN LIST

1 Boiler system
2 Boiler group
20A Step value control boiler
20B Proportional control boiler
3 Boiler number control device
4 Controller
41 Output controller
42 Output switcher
5 Storage unit

The invention claimed is:

1. A boiler system comprising:

a boiler group including a step value control boiler configured to combust at a plurality of stepwise combustion points and a proportional control boiler configured to combust at a continuously changed combustion rate; and a controller configured to control a combustion state of the boiler group in accordance with a required load, wherein the controller includes:

an output controller configured to control the combustion state of the boiler group to cause the proportional control boiler to output steam equivalent to a required steam flow according to the required load; and an output switcher configured to switch, under a condition that a steam flow outputted from the proportional control boiler reaches a predetermined steam flow exceeding a steam flow at a possible combustion point of the step value control boiler, output of the steam flow at the combustion point from the proportional control boiler to the step value control boiler;

wherein the proportional control boiler is configured to have an ecological operation zone in which boiler efficiency of the proportional control boiler is higher than a predetermined threshold, and wherein the predetermined steam flow is more than the steam flow at the combustion point by a steam flow corresponding to a lower limit value within the ecological operation zone.

2. The boiler system according to claim 1, wherein, even when the step value control boiler combusts at a combustion point with maximum efficiency and a steam flow outputted from the proportional control boiler reaches the predetermined steam flow, the output switcher keeps output from the proportional control boiler.

3. A boiler system comprising:

a boiler group including a step value control boiler configured to combust at a plurality of stepwise combustion points and a proportional control boiler configured to combust at a continuously changed combustion rate; and a controller configured to control a combustion state of the boiler group in accordance with a required load, wherein the controller includes:

an output controller configured to control the combustion state of the boiler group to cause the proportional control boiler to output steam equivalent to a required steam flow according to the required load; and an output switcher configured to switch, under a condition that a steam flow outputted from the proportional control boiler reaches a predetermined steam flow exceeding a steam flow at a possible combustion point of the step value control boiler, output of the steam flow at the combustion point from the proportional control boiler to the step value control boiler, wherein the step value control boiler is configured to have a combustion point with maximum efficiency in the plurality of stepwise combustion points, and wherein, even when the step value control boiler combusts at the combustion point with maximum efficiency and a steam flow outputted from the proportional control boiler reaches the predetermined steam flow, the output switcher keeps output from the proportional control boiler.

4. A method for controlling a boiler system which comprises a boiler group including a step value control boiler configured to combust at a plurality of stepwise combustion points and a proportional control boiler configured to combust at a continuously changed combustion rate, and a controller configured to control a combustion state of the boiler group in accordance with a required load, the method comprising:

controlling the combustion state of the boiler group to cause the proportional control boiler to output steam equivalent to a required steam flow according to the required load; and switching, under a condition that a steam flow outputted from the proportional control boiler reaches a predetermined steam flow exceeding a steam flow at a possible combustion point of the step value control boiler, output of the steam flow at the combustion point from the proportional control boiler to the step value control boiler, wherein the proportional control boiler is configured to have an ecological operation zone in which boiler efficiency of the proportional control boiler is higher than a predetermined threshold, and wherein the predetermined steam flow is more than the steam flow at the combustion point by a steam flow corresponding to a lower limit value within the ecological operation zone.

* * * * *